US005346063A

United States Patent [19]

Chow

[11] Patent Number: 5,346,063

[45] Date of Patent: Sep. 13, 1994

[54] TOOL HOLDER

[76] Inventor: Jessie Chow, No. 18, Houchuang Rd., Pei Twen Dist., Taichung, Taiwan

[21] Appl. No.: 53,888

[22] Filed: Apr. 27, 1993

[51] Int. Cl.[5] ..... B65D 85/28

[52] U.S. Cl. ..... 206/376; 206/483; 206/485; 211/70.6; 294/161

[58] Field of Search ..... 206/3, 372, 373, 375, 206/376, 481, 483, 485; 211/70.6; 294/159, 161, 166

[56] References Cited

U.S. PATENT DOCUMENTS

| | | | |
|---|---|---|---|
| 2,119,217 | 5/1938 | Rocchi . | |
| 2,541,597 | 2/1951 | Midling . | |
| 3,077,977 | 2/1963 | Wood | 211/70.6 |
| 3,370,696 | 2/1968 | Groe | 294/161 |
| 4,310,094 | 1/1982 | Hotchkiss, Jr. | 211/70.6 |
| 4,534,465 | 8/1985 | Rothermel et al. | 206/3 |
| 4,666,038 | 5/1987 | Minneman | 294/161 |
| 4,705,168 | 11/1987 | Ward | 206/376 |
| 4,779,914 | 10/1988 | Friedline | 294/161 |
| 4,871,074 | 10/1989 | Bryson et al. | 211/70.6 |
| 4,911,297 | 3/1990 | Suburu | 211/70.6 |
| 5,096,061 | 3/1992 | Wakai | 206/485 |

*Primary Examiner*—David T. Fidei
*Attorney, Agent, or Firm*—Daniel H. Kane

[57] ABSTRACT

A tool holder for holding tools includes a pair of walls extended forward from a board, a number of pairs of notches are formed in the walls for accommodating the tools. Each of the notches includes two ends, in which a shoulder is formed in one end and the other end is located closer to the board. A number of resilient members are projected forward of the board and each aligned with one pair of the notches, the resilient members project inwards of the notches for biasing the tools against the shoulders such that the tools can be stably held in place.

3 Claims, 5 Drawing Sheets

TOOL HOLDER

BACKGROUND OF THE INVENTION

1. Field of the Invention

The present invention relates to a holder, and more particularly to a tool holder.

2. Description of the Prior Art

A typical tool holder is disclosed in U.S. Pat. No. 2,119,217 to Rocchi, filed Feb. 25, 1936. In Rocchi, the tools can not be stably held in place and may slide within the recesses; in addition, the tools are stably retained in place by a retaining member and can not be taken out before the retaining member is opened.

Another type of tool holder is disclosed in U.S. Pat. No. 2,541,597 to Midling, filed Dec. 22, 1947. In Midling, the tools can be easily unloaded in one upsweeping motion of the two hands; however, correspondingly, the tools will be easily disengaged from the tool holder when the tool holder is disposed up-side-down.

The present invention has arisen to mitigate and/or obviate the afore-described disadvantages of the conventional tool holders.

SUMMARY OF THE INVENTION

The primary objective of the present invention is to provide a tool holder with which the tools can be stably held within the tool holder.

In accordance with one aspect of the invention, there is provided a tool holder for holding tools comprising a board including a pair of wall members extended forward therefrom, a plurality pairs of notches formed in the wall members for accommodating the tools, each of the notches including a first end having a shoulder formed therein and a second end close to the board, a plurality of resilient members projected forward of the board and each aligned with one pair of the pairs of notches, the resilient members projecting inwards of the second ends of the notches for biasing the tools against the shoulders, whereby, the tools are stably held in place. It is to be noted that the tools will not be easily disengaged from the tool holder when the tool holder is disposed upside- down.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
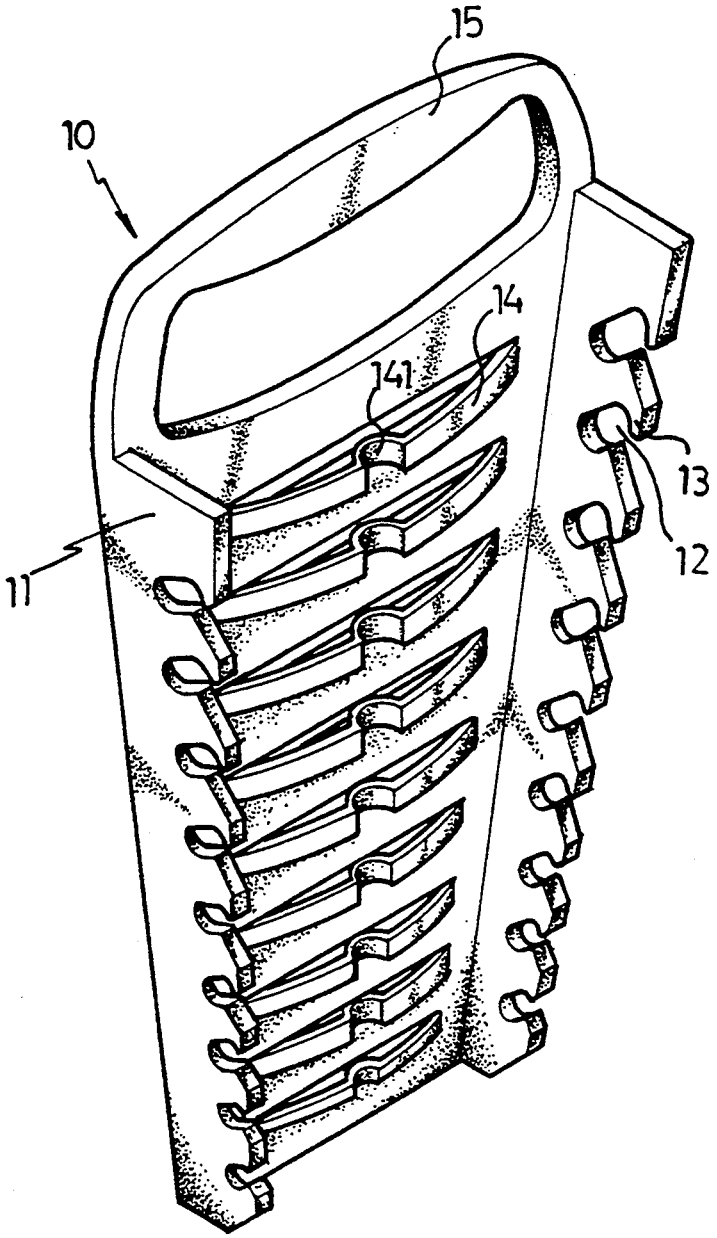
FIG. 1 is a perspective view of a tool holder in accordance with the present invention.
Figure 2:
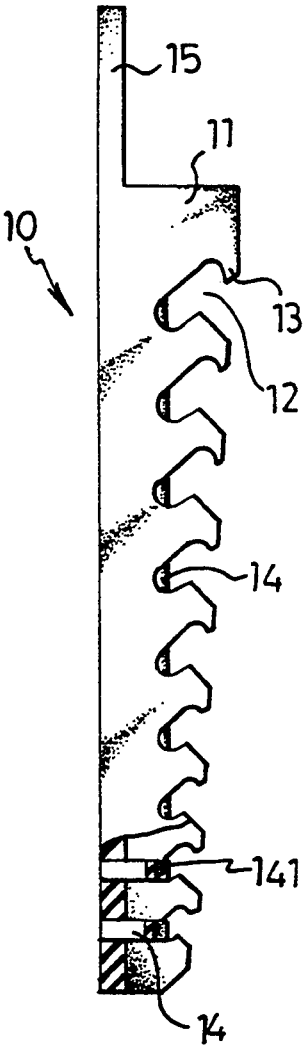
FIGS. 2 and 3 are side elevational views illustrating the operations of the tool holder.
Figure 3:
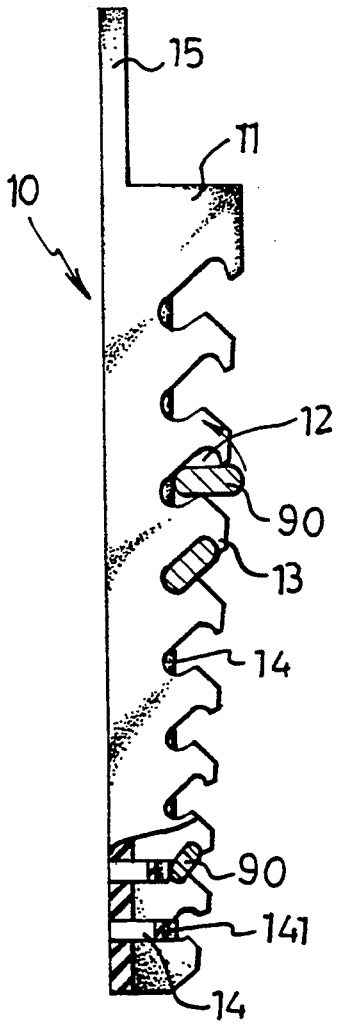
Figure 4:
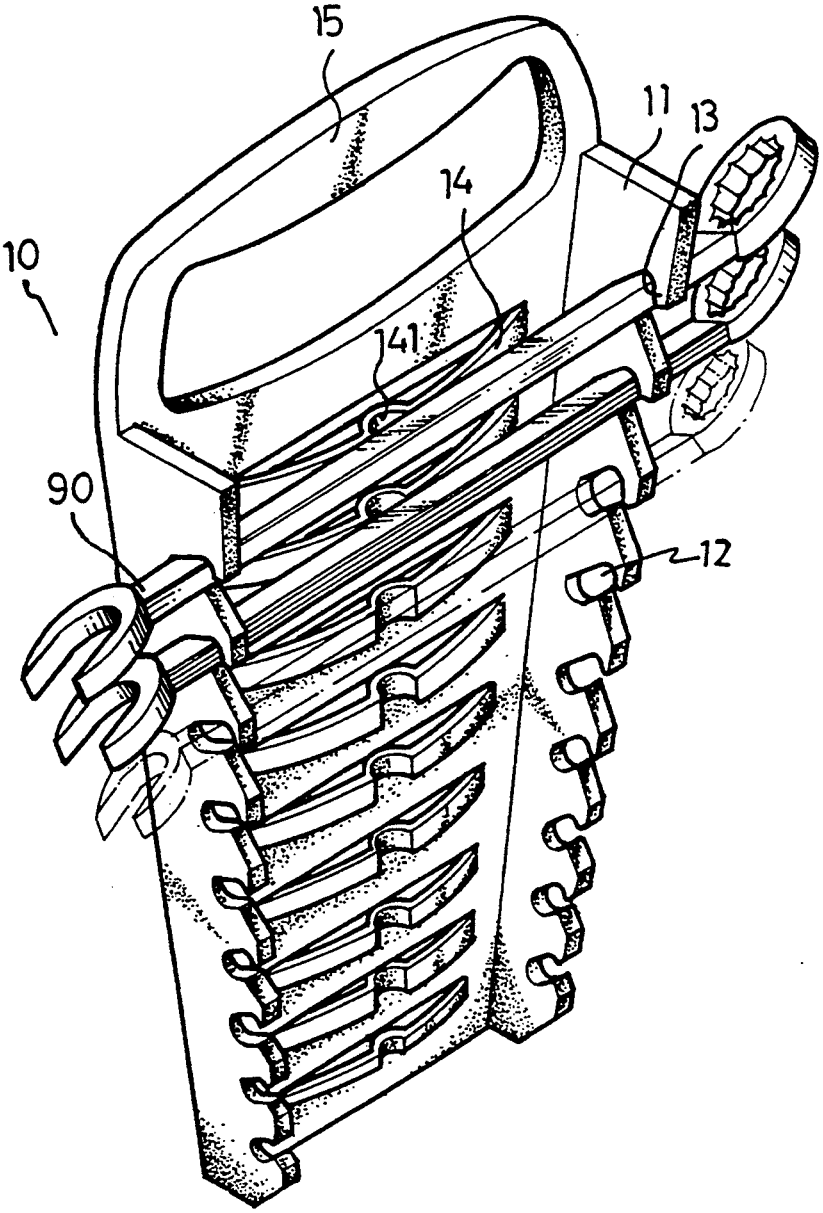
FIG. 4 is a perspective view illustrating the operations of the tool holder.

Referring to the drawings, and initially to FIGS. 1 to 4, a tool holder in accordance with the present invention comprises generally a board 10 including a pair of wall members 11 extended forward therefrom, a hand grip 15 formed in the upper portion thereof for carrying the tool holder, a plurality pairs of notches 12 formed in said wall members 11 for receiving tools 90, such as wrenches as shown in FIG. 4, in which a tool 90 is received in each pair of the notches 12. It is preferable that each of the notches 12 includes an oblong shape having a shoulder 13 formed in the first end thereof and a second end closer to the board 10, best shown in FIGS. 2 and 3. A resilient member 14 is projected forward of the board 10 with a suitable curvature and projected inwards of the second ends of the notches 12, such that the resilient members 14 apply a biasing force against the tool 90 for biasing the tools 90 toward the respective shoulders 13, whereby, the tools 90 can be stably held within the notches 12. It is to be noted that the tools 90 can be stably held within the notches 12 and will not be easily disengaged from the notches 12 when the tool holder is disposed upside-down. In one embodiment of the present invention, as shown in FIGS. 1 and 4, a depression 141 is formed in the middle portion of each of the resilient members 14.

Figure 5:
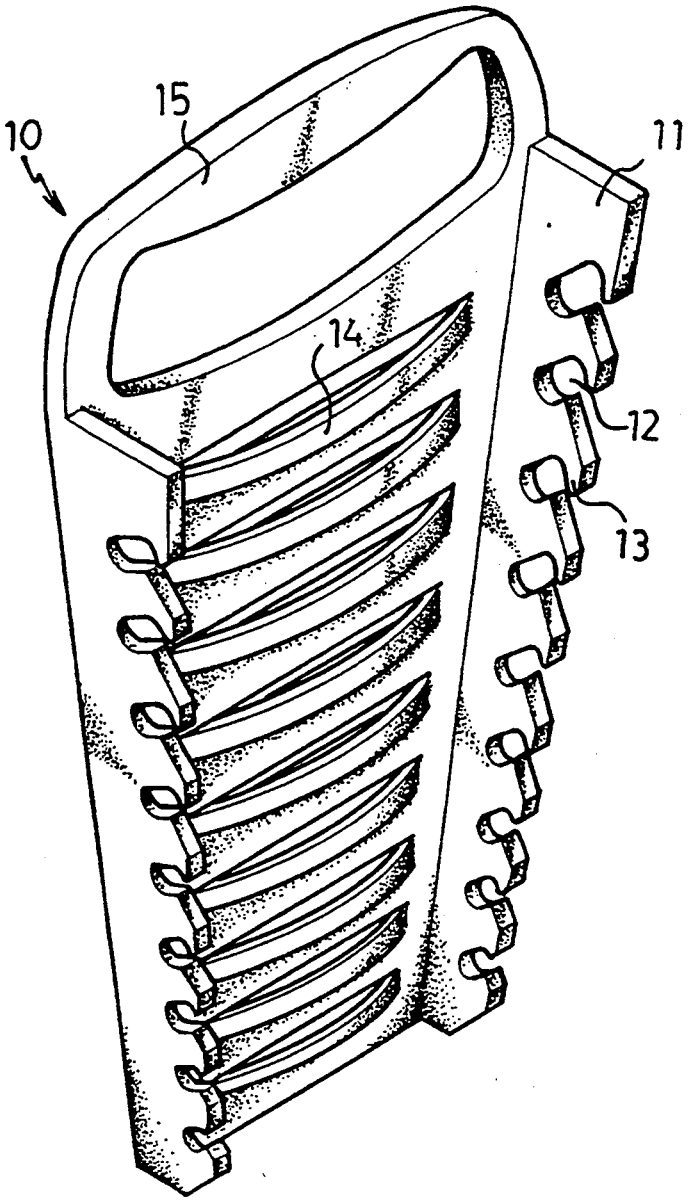
FIGS. 5 and 6 are perspective views illustrating two different types of the resilient members.
Figure 6:
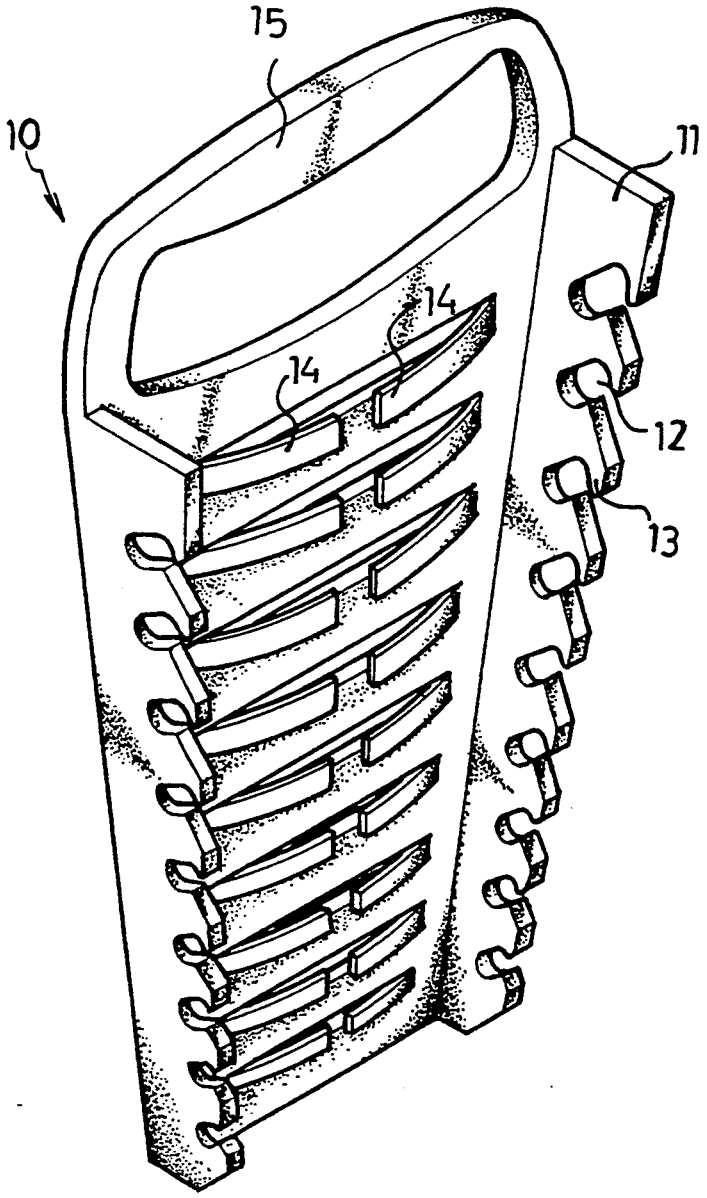

Referring next to FIG. 5, no depression is formed in the resilient members 14; or alternatively, referring next to FIG. 6, the middle portions of the resilient members 14 are cut off such that each of the resilient members 14 includes a pair of resilient blades, the resilient blades may also apply a biasing force against the tools 90 for biasing the tools against the shoulders.

Accordingly, the tools can be stably held within the tool holder in accordance with the present invention.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool holder for holding tools comprising a board including opposite sides and opposite ends, a pair of wall members extending from said opposite sides respectively and formed integral with said board and formed with pairs of aligned notches for receiving said tools, each of said notches including an oblong shape and including a first end having a shoulder formed therein and a second end located close to said board, a plurality of resilient members formed integral with said board and projecting from said board to a space formed between said wall members and each being aligned with one pair of said oblong shape notches, said resilient members projecting towards said second ends of said notches for biasing said tools against said shoulders so as to hold said tools in said notches;

said tool holder having a normal upright position and an inverted upside-down position, wherein the oblong shape notches slope upward from said second end adjacent to the board to the first end shoulder when the tool holder is in the normal upright position, wherein the shoulder of each oblong shape notch comprises a downward facing recess for receiving and holding tools in the normal upright position of the tool holder, said tools being biased along said upward slope of the oblong shape notches into the shoulder recesses by said resilient members, and wherein the tools are held stably in said recesses by gravity if the tool holder is inverted to the upside-down position;

said oblong shape notches being formed with respective openings for inserting and removing tools, said openings being formed on a bottom side of the respective oblong shape notches and being downwardly directed from the oblong shape notches when the tool holder is in the normal upright position.

2. A tool holder according to claim 1, in which said board includes a hand grip formed in one of said opposite ends for carrying said tool holder.

3. A tool holder according to claim 1,in which each of said resilient members includes a curved configuration having a depression in a middle portion.

* * * * *